US009678466B2

(12) United States Patent
Zhu et al.

(10) Patent No.: US 9,678,466 B2
(45) Date of Patent: Jun. 13, 2017

(54) IMAGE FORMING APPARATUS THAT CONTROLS A CONVEYANCE SPEED OF SHEETS WHILE PURGING THE SHEETS AFTER A PAPER JAM

(71) Applicant: KONICA MINOLTA, INC., Chiyoda-ku, Tokyo (JP)

(72) Inventors: Dan Zhu, Hino (JP); Takuya Imai, Mitaka (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/674,853

(22) Filed: Mar. 31, 2015

(65) Prior Publication Data

US 2015/0316887 A1 Nov. 5, 2015

(30) Foreign Application Priority Data

May 2, 2014 (JP) ..... 2014-095210

(51) Int. Cl.
*G03G 15/00* (2006.01)
*G03G 21/16* (2006.01)

(52) U.S. Cl.
CPC ..... *G03G 15/70* (2013.01); *G03G 21/1638* (2013.01); *G03G 2215/00548* (2013.01); *G03G 2215/00552* (2013.01)

(58) Field of Classification Search
CPC ..... G03G 2215/00341; G03G 2215/00552
See application file for complete search history.

(56) References Cited

U.S. PATENT DOCUMENTS 5,815,765 A * 9/1998 Park ..... G03G 15/55 399/18
8,478,147 B2 * 7/2013 Ichikawa ..... G03G 15/043 399/381

(Continued)

FOREIGN PATENT DOCUMENTS

JP 62085261 A 4/1987
JP 04235574 A 8/1992

(Continued)

OTHER PUBLICATIONS

Japanese Office Action (and English translation thereof) dated Jul. 26, 2016, issued in counterpart Japanese Application No. 2014-095210.

*Primary Examiner* — Justin Olamit
(74) *Attorney, Agent, or Firm* — Holtz, Holtz & Volek PC

(57) ABSTRACT

An image forming apparatus includes: an image forming unit configured to form an image on a paper sheet; a conveying unit configured to convey the paper sheet to the image forming unit at a first conveyance speed and convey the paper sheet in the image forming unit at a second conveyance speed; a trouble detecting unit configured to detect a trouble; and a control unit configured to control the conveyance of the paper sheet in the conveying unit and the image formation on the paper sheet in the image forming unit, wherein, when the trouble detecting unit detects a trouble from the paper sheet being conveyed, and the control unit controls the conveying unit to perform a purging process to discharge a troubled paper sheet to the outside of the apparatus, the control unit controls a conveyance speed to be equal to the second conveyance speed.

20 Claims, 10 Drawing Sheets

(56) References Cited

U.S. PATENT DOCUMENTS

| | | | | |
|---|---|---|---|---|
| 8,899,573 | B2 * | 12/2014 | Kamata | G03G 15/6508 270/58.23 |
| 8,998,361 | B2 * | 4/2015 | Yabuki | B41J 2/16526 347/14 |
| 2005/0074267 | A1 * | 4/2005 | Demchock | G03G 15/6567 399/396 |
| 2010/0164171 | A1 * | 7/2010 | Feng | B65H 43/00 271/264 |

FOREIGN PATENT DOCUMENTS

| | | | |
|---|---|---|---|
| JP | 07215530 | A | 8/1995 |
| JP | 08202099 | A | 8/1996 |
| JP | 08301482 | A | 11/1996 |
| JP | 2000095389 | A | 4/2000 |
| JP | 2000255841 | A | 9/2000 |
| JP | 2005352083 | A | 12/2005 |

* cited by examiner

IMAGE FORMING APPARATUS THAT CONTROLS A CONVEYANCE SPEED OF SHEETS WHILE PURGING THE SHEETS AFTER A PAPER JAM

The entire disclosure of Japanese Patent Application No. 2014-095210 filed on May 2, 2014 including description, claims, drawings, and abstract are incorporated herein by reference in its entirety.

BACKGROUND OF THE INVENTION

Field of the Invention

The present invention relates to a technology for stably discharging paper sheets remaining in an apparatus due to a trouble such as a paper jam in an image forming apparatus, an image forming system in which other apparatuses are connected to an image forming apparatus, and an image formation control program for controlling an image forming apparatus and an image forming system.

Description of the Related Art

In an image forming apparatus such as a printer or a copying machine, feeder trays that store paper sheets of more than one type are provided so as to cope with various printing conditions.

There exists another type of image forming apparatus that reverses and circulates a paper sheet having an image formed on a first image thereof, and then re-supplies the paper sheet to the image forming unit, so as to form images on both sides of the paper sheet.

In a case where a paper jam occurs at a site in an image forming apparatus, the operation of the image forming apparatus is stopped, the user removes the trouble-causing paper sheet that has caused the paper jam, and the paper sheets (troubled paper sheets) still remaining in the image forming apparatus are gathered onto a single discharge tray and are automatically discharged through a purging process.

JP 62-85261 A, JP 07-215530 A, and JP 2000-095389 A disclose various suggestions for handling troubled paper sheets when a paper jam occurs.

JP 62-85261 A discloses a technique by which troubled paper sheets are detected by a sensor after the trouble-causing paper sheet is removed, and a purging process is then automatically performed.

JP 07-215530 A discloses a process of activating a timer every time a sensor detects a paper sheet during a purging process, and determining the purging process to have been completed if there is no detection notification over a certain period of time.

JP 2000-095389 A discloses a technique by which conveyance drive motors provided in respective conveyance paths are activated at different times in a purging process so as to prevent collisions between paper sheets in an apparatus having junctions between the paper sheet conveyance paths.

Where the conveyance speed of a paper sheet at the time of the transfer of a toner image onto the paper sheet in the image forming unit is the process conveyance speed in an image forming apparatus, there is a known conveyance control method by which a paper sheet from a sheet feeding unit is conveyed to the site in front of the image forming unit at a sheet conveyance speed that is higher than the process conveyance speed.

Even if the sheet feeding slightly delays as the paper slips while being conveyed, the delay time can be absorbed by a temporary halt in front of the image forming unit by using this conveyance control method, and the image formation intervals can be made uniform to secure productivity.

Also, not only in a case where paper sheets are successively conveyed from the same feeder tray but also in a case where feeder trays are switched while image formation is being performed, reduction in productivity can be avoided or minimized, as the sheet conveyance speed is higher than the process conveyance speed.

In such an image forming apparatus, a paper sheet is conveyed from a feeder tray to the site (the position of resist rollers) in front of the image forming unit at the sheet conveyance speed, and is conveyed from the resist rollers at the process conveyance speed. Image formation is then performed.

There are cases where the bottom edge of a paper sheet of a certain paper size is still held between rollers of the sheet feeding unit when the resist rollers are rotated. In such a case where the bottom edge of a paper sheet is still held between rollers of the sheet feeding unit when the paper sheet is moved by the resist rollers, rollers of the sheet feeding unit are made to rotate by a clutch mechanism, to convey the paper sheet at the process conveyance speed.

In such a situation, however, the clutch mechanism of the rollers of the sheet feeding unit might be switched on so as to start conveyance of the next paper sheet from a feeder tray. As a result, the bottom edge of the paper sheet being conveyed by the resist rollers is held between the rollers of the sheet feeding unit, and the bottom edge of the paper sheet is conveyed at the sheet conveyance speed. Although the top edge of the paper sheet is being conveyed by the resist rollers at the process conveyance speed, the bottom edge of the paper sheet is pushed from the bottom at the sheet conveyance speed that is higher than the process conveyance speed. As a result, the paper sheet might be folded or crumpled, to cause a paper jam.

In an image forming apparatus in such a state, the trouble-causing paper sheet is removed after the occurrence of the paper jam, and the troubled paper sheets remaining in the apparatus are then discharged through a purging process. In that case, the paper sheet needs to be conveyed in the same manner as those in a regular image forming operation.

After the occurrence of the paper jam, the remaining paper sheets are still moving through the inertia of the conveyance rollers. Furthermore, due to the trouble-causing paper sheet removing operation performed by the user, the paper sheet state might differ from that at the time of the occurrence of the jam.

Therefore, in a case where the same paper sheet conveyance as that in a regular image forming operation is performed for a purging process, the paper in the sheet feeding unit is pushed into the image forming unit due to the above described difference between the process conveyance speed and the sheet conveyance speed, for example, and might cause another paper jam. In an image forming system in which a sheet feeding apparatus is connected to an image forming apparatus, the same problem as above might be caused.

Such a problem cannot be solved by any of the techniques disclosed in the above mentioned patent documents, and has not been recognized as a problem that should be solved.

SUMMARY OF THE INVENTION

The present invention has been made in view of the above problem, and an object thereof is to realize an image forming apparatus, an image forming system, and an image formation control program that can stably discharge troubled paper sheets remaining in the image forming apparatus or the image forming system through a purging process.

An image forming apparatus, an image forming system and an image formation control program as a mode to solve the above described problem are designed as follows.

(1) To achieve the abovementioned object, according to an aspect, an image forming apparatus or an image forming system reflecting one aspect of the present invention comprises: an image forming unit that forms an image on a paper sheet; a conveying unit that conveys the paper sheet to the image forming unit at a first conveyance speed and conveys the paper sheet in the image forming unit at a second conveyance speed when the image is formed on the paper sheet in the image forming unit, the second conveyance speed being lower than the first conveyance speed; a trouble detecting unit that detects a trouble related to conveyance of the paper sheet in the conveying unit; and a control unit that controls the conveyance of the paper sheet in the conveying unit and the image formation on the paper sheet in the image forming unit. In this image forming apparatus or the image forming system, when the trouble detecting unit detects a trouble from the paper sheet being conveyed, and the control unit controls the conveying unit to perform a purging process to discharge a troubled paper sheet to the outside of the apparatus after a trouble-causing paper sheet that has caused the trouble is removed, the control unit controls the conveyance speed at which the troubled paper sheet is conveyed to the image forming unit and the conveyance speed at which the troubled paper sheet is conveyed in the image forming unit to be equal to the second conveyance speed, the trouble-causing paper sheet being the paper sheet from which the trouble is detected by the trouble detecting unit, the troubled paper sheet being the paper sheet remaining in the apparatus other than the trouble-causing paper sheet when the trouble is detected by the trouble detecting unit.

(2) In Item. (1), if the second conveyance speed can be selected from among speeds in accordance with the type of the paper sheet, the control unit preferably performs the control so as to determine the second conveyance speed in accordance with the type of the troubled paper sheet when controlling the conveying unit to perform the purging process.

(3) In Item. (2), when controlling the conveying unit to perform the purging process, the control unit preferably selectively determines the second conveyance speed in accordance with the type of the troubled paper sheet or determines the second conveyance speed regardless of the type of the troubled paper sheet.

(4) In Item. (1), if the second conveyance speed can be selected from among speeds, the control unit preferably performs the control to select a speed closer to the highest speed than to an intermediate speed among the speeds when controlling the conveying unit to perform the purging process.

(5) In Items. (2) to (4), when controlling the conveying unit to perform the purging process, the control unit preferably selectively determines the second conveyance speed in accordance with the type of the troubled paper sheet or determines the second conveyance speed to be a speed closer to the highest speed than to an intermediate speed among the speeds regardless of the type of the troubled paper sheet.

(6) In Items. (2), (3), and (5), when controlling the conveying unit to perform the purging process, the control unit preferably determines whether there is a troubled paper sheet onto which an image has been transferred in the image forming unit but has not been fixed, determines the second conveyance speed in accordance with the type of the troubled paper sheet when there is the unfixed troubled paper sheet, and determines the second conveyance speed regardless of the paper type when there is no unfixed troubled paper sheet.

(7) In Item. (1), the control unit preferably determines the second conveyance speed during the purging process based on the second conveyance speed of the paper sheet used before the trouble is detected by the trouble detecting unit.

(8) In Items. (1) to (7), the control unit preferably controls the conveying unit to discharge the troubled paper sheet to the outside without a halt when performing the purging process.

(9) In Items. (1) to (8), a sensor that detects the paper sheet is further provided at a site in the conveying unit, and, if a notification of detect of the paper sheet is not generated from the sensor over a predetermined period of time while the purging process is performed, the control unit preferably determines that the purging process has been completed.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, modes (hereinafter referred to as embodiments) for carrying out the present invention will be described in detail with reference to the drawings. However, the scope of the invention is not limited to the illustrated examples.

[Structure of an Entire Image Forming Apparatus]

Figure 1:
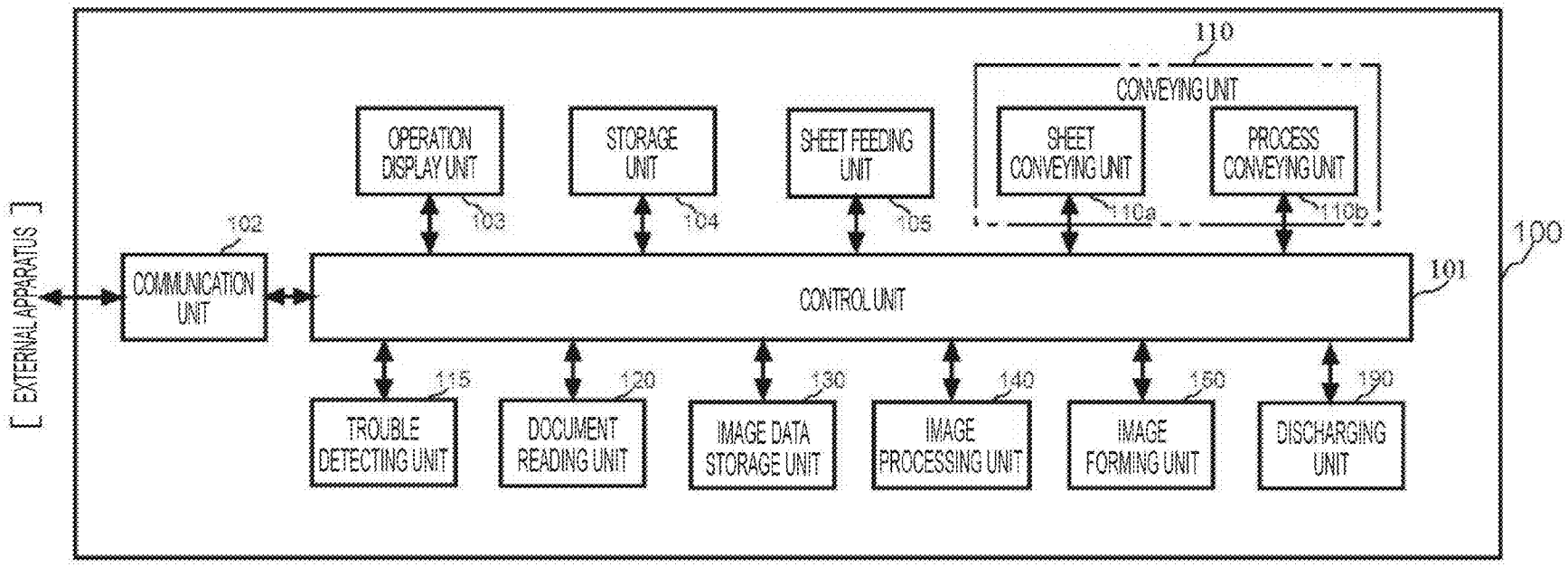
FIG. 1 is a block diagram showing the structure of an image forming apparatus according to an embodiment of the present invention.
Figure 2:
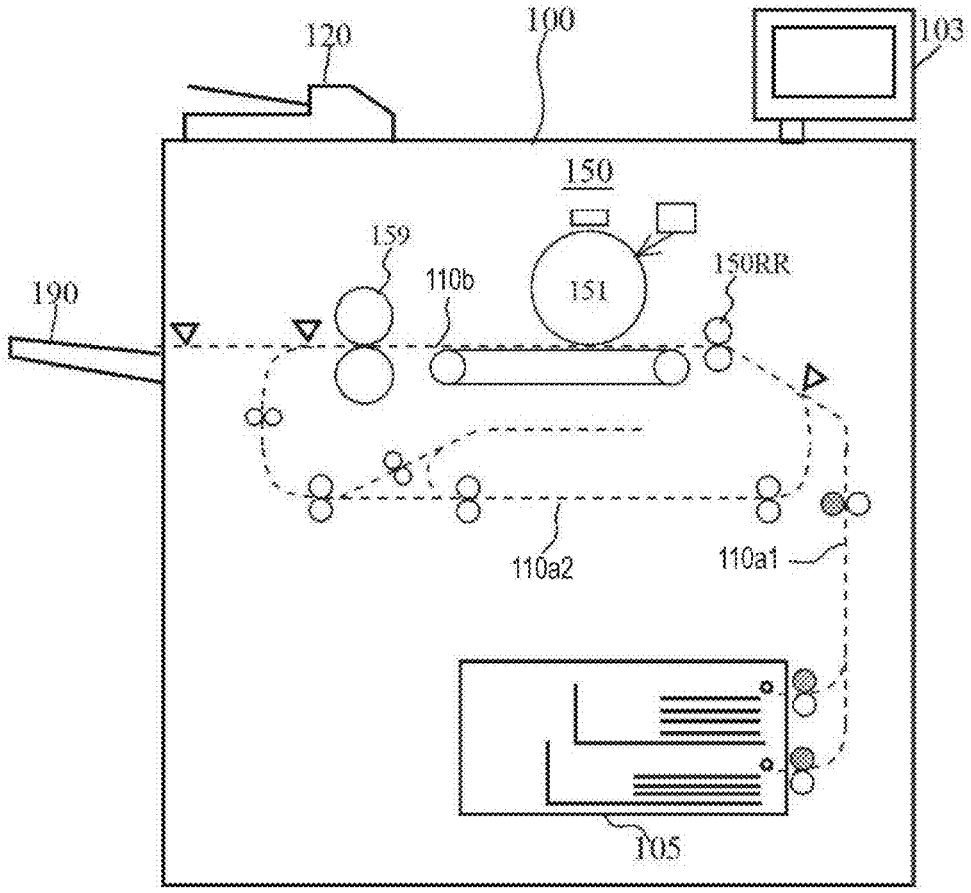
FIG. 2 is a schematic view of the structure of the image forming apparatus according to the embodiment of the present invention.

Referring first to FIGS. 1 and 2, the structure of an image forming apparatus according to this embodiment is described.

FIG. 1 shows the structural elements having the respective functions of the image forming apparatus. FIG. 2 is a schematic cross-sectional view of the structures of the respective components of the image forming apparatus.

The image forming apparatus 100 includes a control unit 101, a communication unit 102, an operation display unit 103, a storage unit 104, a sheet feeding unit 105, a conveying unit 110, a trouble detecting unit 115, a document reading unit 120, an image data storage unit 130, an image processing unit 140, an image forming unit 150, and a discharging unit 190.

The control unit 101 controls the respective components in the image forming apparatus 100. The communication unit 102 communicates with another apparatus connected thereto. The operation display unit 103 notifies the control unit 101 of an operation input signal corresponding to an operation input made by an operator, and displays the state of the image forming apparatus 100. The storage unit 104 stores a control program and various kinds of setting data, and also is used as the work area for the control program. The sheet feeding unit 105 feeds stored paper sheets in synchronization with image formation. The conveying unit 110 conveys, at a predetermined speed, each fed paper sheet on which an image is to be formed. The trouble detecting unit 115 performs jam detection as trouble detection with sensors (not shown) of respective components. The document reading unit 120 scans each document and generates image data. The image data storage unit 130 stores image data and various kinds of data to be used when an image is formed. The image processing unit 140 performs various kinds of image processing necessary for image formation. The image forming unit 150 performs printing (hereinafter referred to as "image formation") based on an image formation instruction and image data subjected to image processing. In the image forming unit 150, a toner image formed on an image carrier 151 is transferred onto a paper sheet, and the toner image transferred onto the paper sheet is fixed by a fixing unit 159. Known components for charging, exposure, development, transfer, and fixing are not explained herein. The discharging unit 190 discharges each paper sheet onto a discharge tray or the like located outside the image forming apparatus 100.

In this embodiment, after a user removes the trouble-causing paper sheet (the paper sheet that has caused a trouble) at a time of a trouble such as a paper jam, the control unit 101 performs control so that the troubled paper sheet still remaining in the image forming apparatus 100 at that point is automatically discharged in a purging process.

[Configuration of an Entire Image Forming System]

Figure 3:
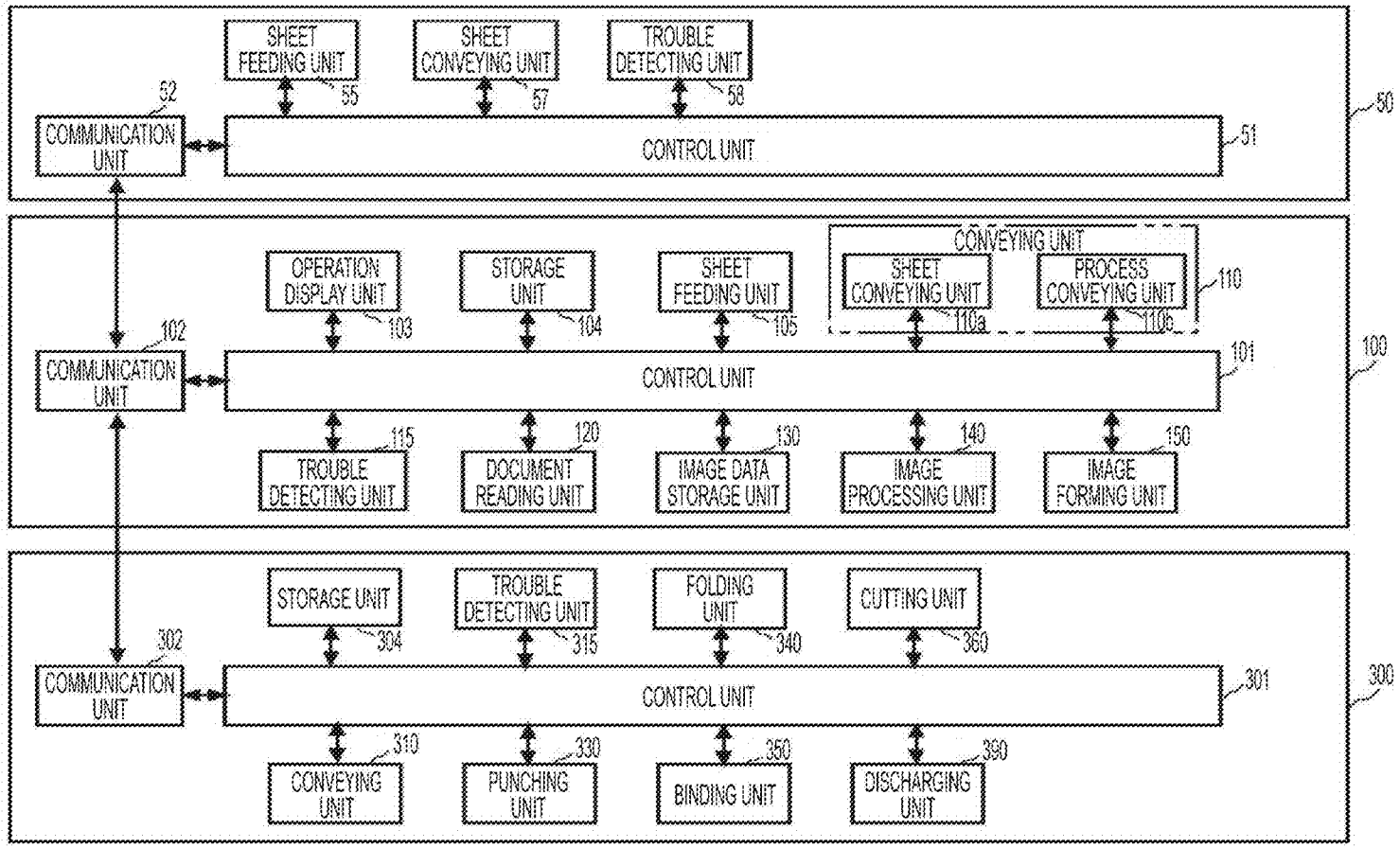
FIG. 3 is a block diagram showing the configuration of an image forming system according to the embodiment of the present invention.
Figure 4:
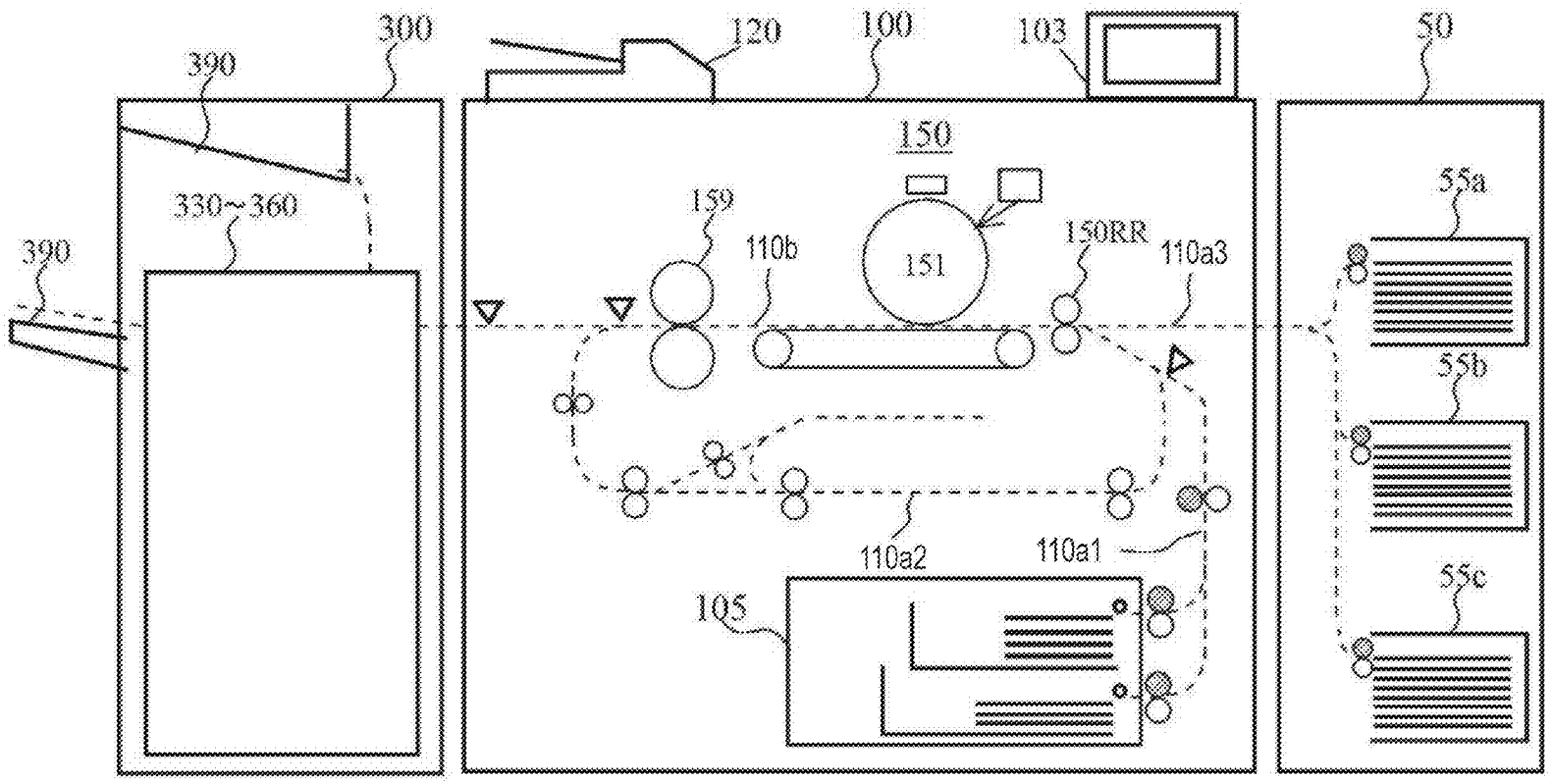
FIG. 4 is a schematic view of the configuration of the image forming system according to the embodiment of the present invention.

Referring now to FIGS. 3 and 4, the configuration of an image forming system according to this embodiment is described.

FIG. 3 shows the structural elements having the respective functions of the image forming system. FIG. 4 is a schematic cross-sectional view of the structures of the respective components of the image forming system.

This image forming system includes a sheet feeding apparatus 50, an image forming apparatus 100, and a post-processing apparatus 300.

The sheet feeding apparatus 50 is placed in the stage before the image forming apparatus 100, and includes a control unit 51, a communication unit 52, a sheet feeding unit 55, a sheet conveying unit 57, and a trouble detecting unit 58. The control unit 51 controls the respective components in the sheet feeding apparatus 50. The communication unit 52 communicates with the image forming apparatus 100. The sheet feeding unit 55 feeds a stored paper sheet at a predetermined time. The sheet conveying unit 57 conveys a paper sheet fed from the sheet feeding unit 55 toward the image forming apparatus 100. The trouble detecting unit 58 performs jam detection as trouble detection with sensors of the respective components in the sheet feeding apparatus 50.

The image forming apparatus 100 is in the stage that follows the stage of the sheet feeding apparatus 50, and includes a control unit 101, a communication unit 102, an operation display unit 103, a storage unit 104, a sheet feeding unit 105, a conveying unit 110, a trouble detecting unit 115, a document reading unit 120, an image data storage unit 130, an image processing unit 140, and an image forming unit 150. As for the image forming apparatus 100, the same components as those shown in FIGS. 1 and 2 are denoted by the same reference numerals as those used in FIGS. 1 and 2, and explanation of them is not repeated herein.

The post-processing apparatus 300 is in the stage that follows the stage of the image forming apparatus 100, and includes a control unit 301, a communication unit 302, a storage unit 304, a conveying unit 310, a trouble detecting unit 315, a punching unit 330, a folding unit 340, a binding unit 350, a cutting unit 360, and a discharging unit 390 that discharges paper sheets onto a tray as a discharge destination.

The control unit 301 controls the respective components in the post-processing apparatus 300. The communication unit 302 communicates with the image forming apparatus 100. The storage unit 304 stores a control program and various kinds of setting data, and also is used as the work area for the control program. The conveying unit 310 conveys each paper sheet at a predetermined speed in the post-processing apparatus 300. The trouble detecting unit 315 detects a paper jam with sensors provided at appropriate locations in the post-processing apparatus 300. The punching unit 330 punches paper sheets. The folding unit 340 folds each paper sheet in two or three. The binding unit 350 performs a binding process such as saddle stitching or side stitching on paper sheets, and creates a booklet. The cutting unit 360 cuts the edge portions of the booklet. The discharging unit 390 discharges paper sheets onto a tray as a discharge destination. The respective paper sheet processing functions and the respective structural elements in the above described post-processing apparatus 300 are merely examples, and are not limited to the above.

In this embodiment, after a user removes the trouble-causing paper sheet (the paper sheet that has caused a trouble) at a time of a trouble such as a paper jam, the control unit 101 performs control so that the troubled paper sheet still remaining in the image forming system at that point is automatically discharged in a purging process.

[Paper Sheet Conveyance]

In the image forming apparatus shown in FIG. 1, the conveying unit 110 includes a sheet conveying unit 110*a* that conveys a paper sheet to the image forming unit 150 at a first conveyance speed, and a process conveying unit 110*b* that conveys a paper sheet in the image forming unit 150.

In this image forming apparatus, the sheet conveying unit 110*a* includes a sheet conveying unit 110*a*1 that conveys a paper sheet stored in the sheet feeding unit 105 to the image forming unit 150 at the first conveyance speed, and a sheet conveying unit 110*a*2 that conveys a paper sheet being circulated during two-sided image formation to the image forming unit 150 at the first conveyance speed, as shown in FIG. 2.

In the image forming system shown in FIG. 3, the conveying unit 110 includes a sheet conveying unit 110*a* that conveys a paper sheet to the image forming unit 150 at a first conveyance speed, and a process conveying unit 110*b* that conveys a paper sheet in the image forming unit 150.

In this image forming system, the sheet conveying unit 110*a* includes a sheet conveying unit 110*a*1 that conveys a paper sheet stored in the sheet feeding unit 105 to the image forming unit 150 at the first conveyance speed, a sheet conveying unit 110*a*2 that conveys a paper sheet being circulated during two-sided image formation to the image forming unit 150 at the first conveyance speed, and a sheet conveying unit 110*a*3 that conveys a paper sheet fed from the sheet feeding apparatus 50 to the image forming unit 150 at the first conveyance speed, as shown in FIG. 4.

In FIGS. 2 and 4, the sheet conveying unit 110*a*1 and the sheet conveying unit 110*a*2 merge in front of resist rollers 150RR, but do not necessarily merge in this manner.

Figure 5:
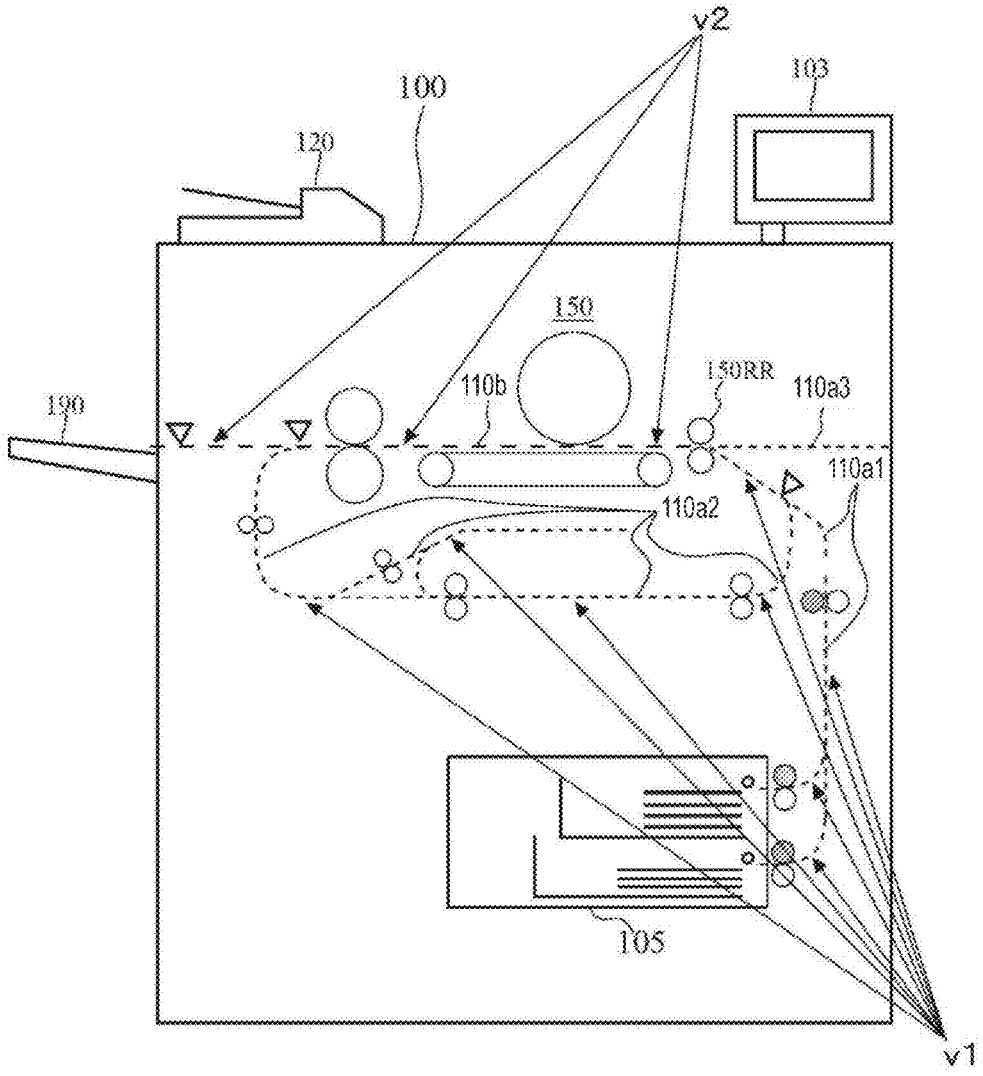
FIG. 5 is a diagram for explaining a situation of paper sheet conveyance in the embodiment of the present invention.

Here, the first conveyance speed is the sheet conveyance speed during paper sheet conveyance, and a second conveyance speed is the process conveyance speed during image formation on a paper sheet. This situation is illustrated in FIG. 5. In FIG. 5, v1 represents the first conveyance speed (the sheet conveyance speed), and v2 represents the second conveyance speed (the process conveyance speed).

At the sheet conveyance speed, which is higher than the process conveyance speed, a paper sheet from the sheet conveying unit 110*a*1 or the sheet conveying unit 110*a*2 is conveyed to the resist rollers 150RR in front of the image forming unit 150 slightly earlier than the start of the image formation. The paper sheet is temporarily held at the resist rollers 150RR, and is then conveyed at the process conveyance speed in time for the predetermined start of the image formation. Even if the paper sheet slightly delays as it slips while being conveyed, the delay time can be absorbed by the temporary halt at the resist rollers 150RR in front of the image forming unit 150 in the above manner, and the image formation intervals can be made uniform.

Accordingly, the resist rollers 150RR serve as a boundary between the sheet conveying unit 110*a* and the process conveying unit 110*b*.

In FIGS. 2, 4, and 5, there are cases where the bottom edge of a paper sheet of a certain paper size is still held between rollers of a sheet conveying unit when the resist rollers 150RR are rotated. In such a case where the bottom edge of a paper sheet is still held between rollers of a sheet conveying unit when the paper sheet is moved by the resist rollers 150RR, rollers of the sheet conveying unit are made to rotate by a clutch mechanism, to convey the paper sheet at the process conveyance speed. In FIGS. 2 and 4, the rollers that are shaded are the rollers that can be made to rotate by the clutch mechanism.

[Operation of the Embodiment]

Figure 6:
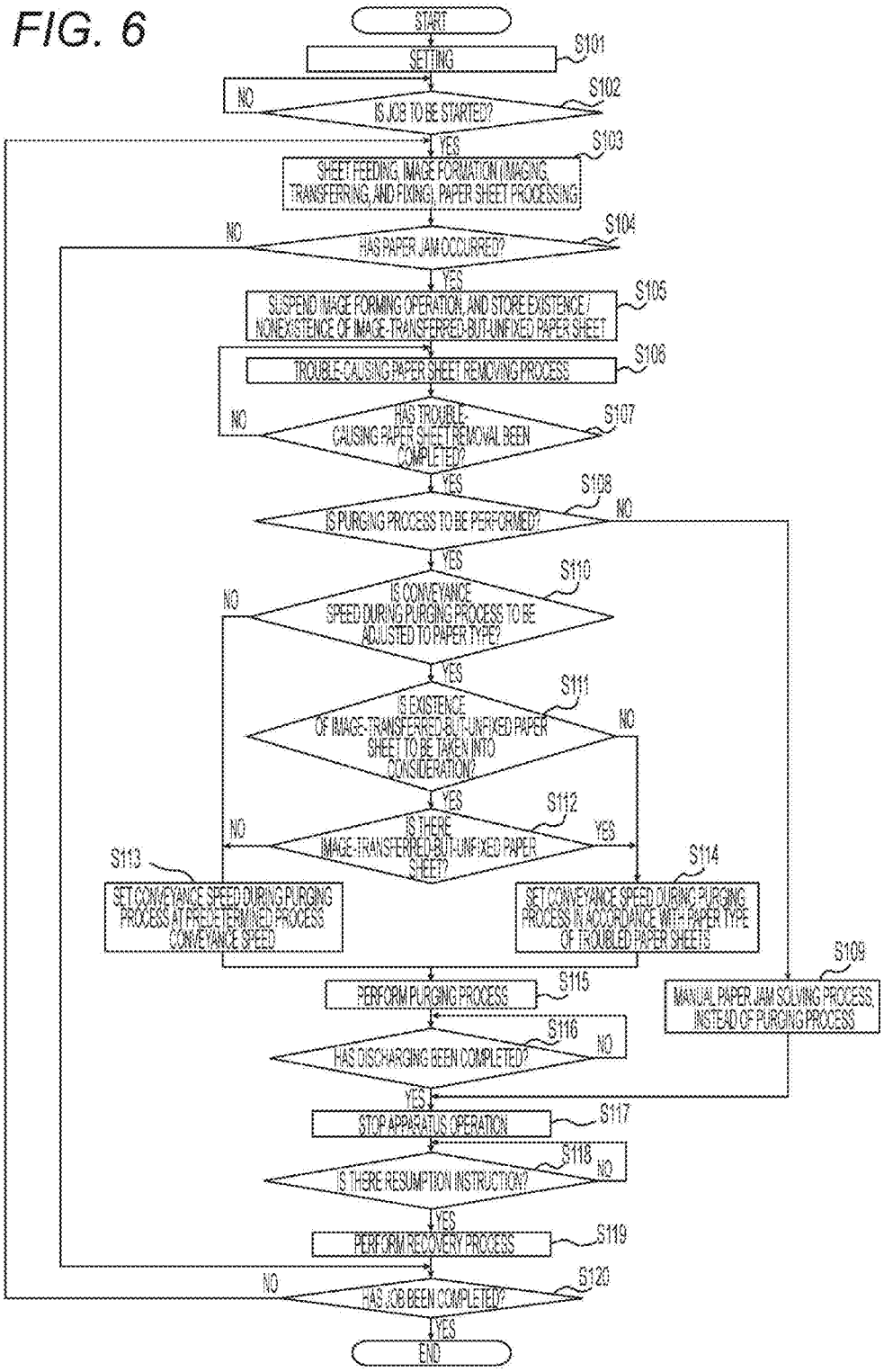
FIG. 6 is a flowchart showing a purging process in the embodiment of the present invention.

Referring now to the flowchart shown in FIG. 6 and the explanatory diagrams shown in FIGS. 7 to 10, the image forming apparatus, the image forming system, and an image formation control program of this embodiment are described in conjunction with operation procedures.

First, the control unit 101 receives settings from the operation display unit 103 at the start of an operation of the image forming apparatus 100 or the start of job execution (step S101 in FIG. 6).

The settings may include various kinds of setting items. The contents of the setting items may include whether to perform a purging process, the contents of a purging process, and the like. The description below is based on the assumption that a purging process is to be performed in this embodiment.

Figure 7:
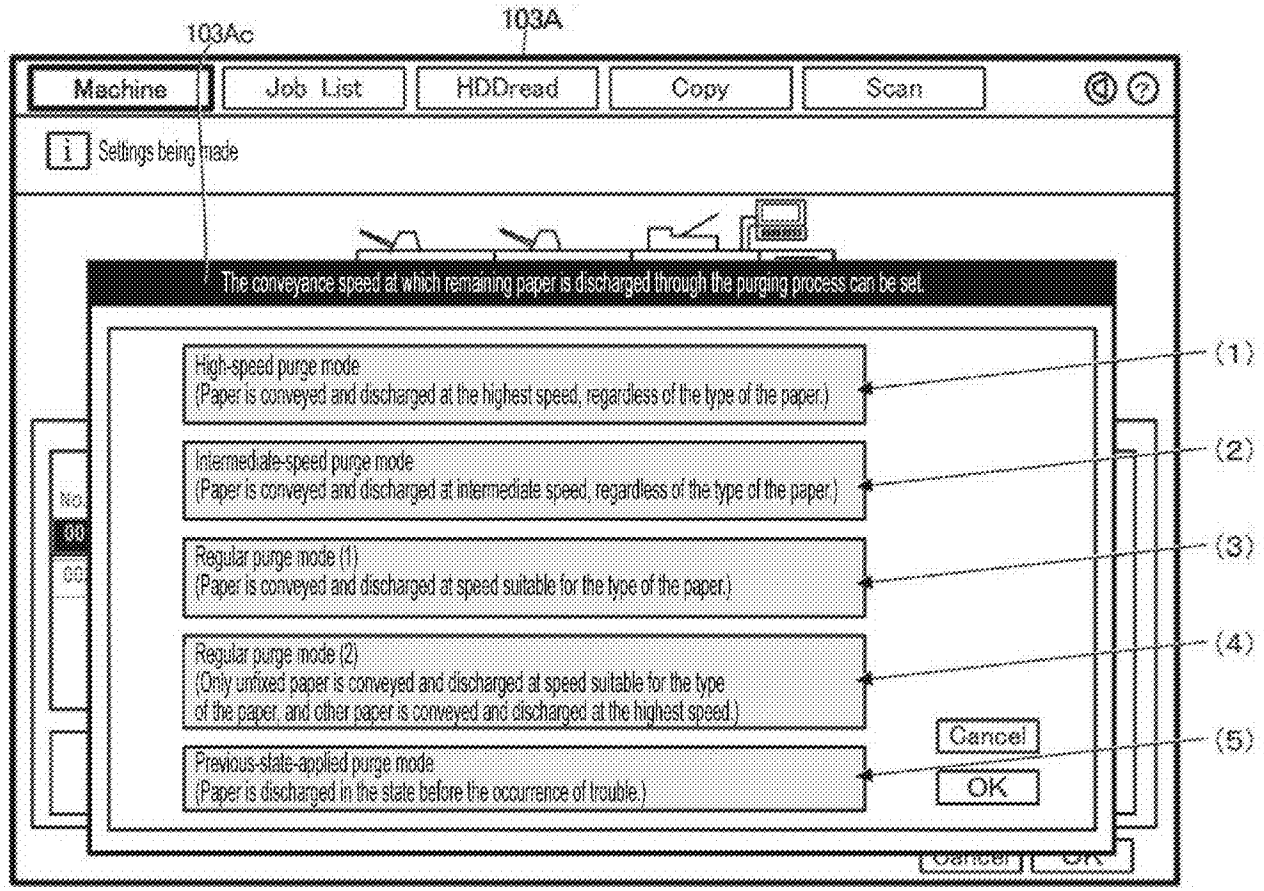
FIG. 7 is a diagram for explaining a setting screen in the embodiment of the present invention.

As for the content of the purging process to be performed, the control unit 101 causes the operation display unit 103 to display the setting screen 103A shown in FIG. 7, for example. In a sub setting screen 103Ac in this setting screen 103A, it is possible to set a conveyance speed at which the remaining paper sheet is to be conveyed and discharged during the purging process.

An example of options of discharge settings to be shown on the sub setting screen 103Ac in FIG. 7 is as follows.

"High-speed purge mode": the mode in which the remaining paper sheet is discharged while the sheet conveyance speed and the process conveyance speed are controlled to be equal to the highest process conveyance speed (or be higher than the intermediate speed and be closer to the highest speed), regardless of the type of the remaining paper sheet (option (1) in FIG. 7). Since defective fixing does not become a problem as far as the remaining paper sheet is concerned, productivity is secured by discharging the remaining paper sheet as quickly as possible.

"Intermediate-speed purge mode": the mode in which the remaining paper sheet is discharged while the sheet conveyance speed and the process conveyance speed are controlled to be equal to the intermediate process conveyance speed (or be closer to the intermediate speed), regardless of the type of the remaining paper sheet (option (2) in FIG. 7). With fixing properties and conveyance stability being also taken into consideration for the remaining paper sheet, the remaining paper sheet is discharged as stably as possible.

"Regular purge mode (1)": the mode in which the remaining paper sheet is discharged while the sheet conveyance speed and the process conveyance speed are controlled to be a process conveyance speed suitable for the type of the remaining paper sheet (option (3) in FIG. 7). With fixing properties being also taken into consideration for the remaining paper sheet, the remaining paper sheet is discharged as stably as possible.

"Regular purge mode (2)": the mode in which the remaining paper sheet is discharged while the sheet conveyance speed and the process conveyance speed are controlled to be a process conveyance speed suitable for the type of the remaining paper sheet, if a toner image has been transferred onto the remaining paper sheet but has not been fixed onto the remaining paper sheet (option (4) in FIG. 7). If there is no remaining paper sheet having a toner image transferred but not yet fixed thereonto, and there is a remaining paper sheet having no toner image transferred thereonto or having a toner image already fixed thereonto, the remaining paper sheet is discharged while the sheet conveyance speed and the process conveyance speed are controlled to be closer to a higher process conveyance speed. If there is a remaining paper sheet having a toner image transferred but not yet fixed thereonto, stable fixing properties are taken into consideration. If there is no remaining paper sheet having a toner image transferred but not yet fixed thereonto, productivity is taken into consideration. In this manner, a balanced state is maintained with high efficiency.

"Previous-state-applied purge mode": the mode in which the remaining paper sheet is discharged while the sheet conveyance speed and the process conveyance speed are controlled to be equal to the process conveyance speed used before the trouble such as a paper jam is detected (option (5) in FIG. 7). A user's intention is reflected in a user setting, and the remaining paper sheet is discharged while the operation state is made similar to the user setting.

As described above, the conveyance speed during the purging process can be selected by a user. Accordingly, the purging process can be performed in a state desired by the user, such as a state in which high-speed discharging is performed while emphasis is put on productivity, a state in which discharging is stably performed at a conveyance speed that is set in accordance with the type of the paper sheet, a state in which discharging is performed while a balance is kept between stability and productivity, or a state in which discharging is performed in the previous state that is set by the user. No matter which state is selected, stable discharging is performed, as the sheet conveyance speed and the process conveyance speed are made equal to a process conveyance speed.

In the above described settings, "high-speed" does not mean a high speed as opposed to a low speed in terms of an absolute speed value. Instead, "high-speed" means a relative speed in the conveying unit 110 that is designed to operate at process conveyance speeds that are switched. If two kinds of conveyance speeds can be set, a low speed and a high speed can be set. If three kinds of conveyance speeds can be set, a low speed, an intermediate speed, and a high speed can be set. If more minute settings are possible, the lowest speed, a low speed, a lower intermediate speed, an intermediate speed, a higher intermediate speed, a high speed, the highest speed, and the like can be set.

After the above described settings are made, the control unit 101 monitors jobs from the operation display unit 103 or an external computer for an image formation start instruction (step S102 in FIG. 6).

When there is an image formation start instruction (YES in step S102 in FIG. 6), the control unit 101 controls the sheet feeding unit 105, the conveying unit 110, the image data storage unit 130, the image processing unit 140, and the image forming unit 150, so that an image is formed on a paper sheet based on designated image data as a job (step S103 in FIG. 6). If a sheet feed from the sheet feeding apparatus 50 outside the image forming apparatus 100 is designated, the control unit 101 controls the sheet feed from the sheet feeding unit 55 via the control unit 51.

If post-processing at the post-processing apparatus 300 is designated, the control unit 101 controls paper sheet conveyance and paper sheet processing in the post-processing apparatus 300 via the control unit 301. While the image formation in the job is being performed, the control unit 101 monitors a result of trouble detection being performed by the trouble detecting unit 115. If a sheet feed from the sheet feeding apparatus 50 is designated, a result of trouble detection being performed by the trouble detecting unit 58 is monitored. If paper sheet processing at the post-processing apparatus 300 is designated, a result of trouble detection being performed by the trouble detecting unit 315 is monitored.

A trouble detected by the trouble detecting unit 115 or the like is a result of detection performed by a sensor placed in the sheet conveyance path. Such a trouble may be that a paper sheet does not reach the destination even when a predetermined time has come, or a paper sheet continues to be detected by the sensor even when the paper sheet is supposed to have passed already. When there is a trouble in the paper sheet conveyance at the position of a sensor or a position between sensors, the trouble detecting unit 115 or the like notifies the control unit 101 of "trouble occurrence: detail aaa, position bbb", for example.

The paper sheet that is the cause of a trouble detected in the above manner is called the "trouble-causing paper sheet". The paper sheet that remains in the conveyance path in the image forming apparatus 100 or the image forming system when a trouble is detected is called the "troubled paper sheet" Therefore, the troubled paper sheet is not any of the paper sheets that are stored in the feeder tray and have not been fed into the apparatus, and the paper sheets stacked in the discharging unit.

In a case where no trouble detection result is sent from the trouble detecting unit 115 or the like (NO in step S104 in FIG. 6), image formation is repeated until an image is formed on the last paper sheet among the designated number of paper sheets in the job (step S120 in FIG. 6).

Figure 8:
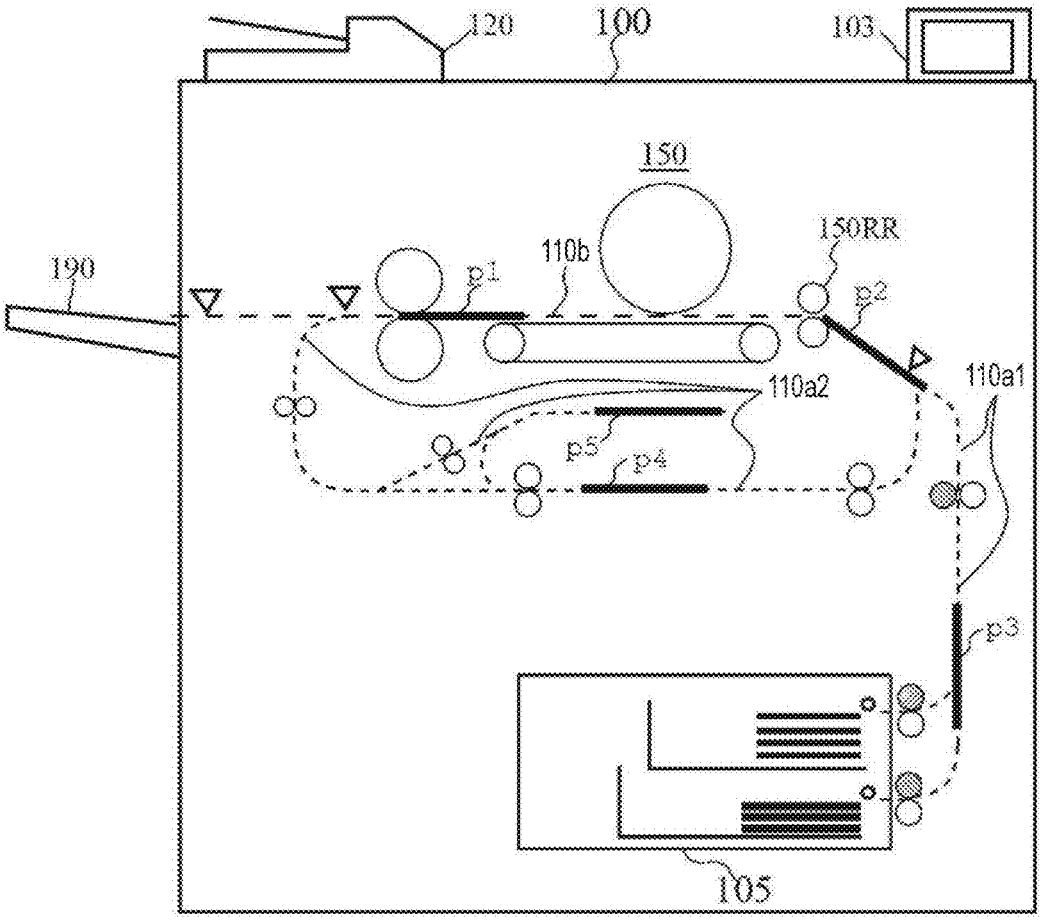
FIG. 8 is a diagram for explaining a situation of paper sheet conveyance in the embodiment of the present invention.

FIG. 8 shows a situation where the image forming apparatus 100 is performing image formation, and five paper sheets p1 to p5 exist as remaining paper sheets. In this case, the paper sheet p1 is being conveyed at the process conveyance speed v2, and the paper sheets p2, p3, p4, and p5 are being conveyed at the sheet conveyance speed v1.

In a case where a trouble detection result such as a notification of a paper jam occurrence is sent from the trouble detecting unit 115 or the like (YES in step S104 in FIG. 6), on the other hand, the control unit 101 controls the respective components to suspend the image forming operation and stop conveying both the trouble-causing paper sheet and the troubled paper sheets (step S105 in FIG. 6). The control unit 101 also determines whether the troubled paper sheets include a paper sheet onto which an image has been transferred at the image forming unit 150 but has not been fixed at the fixing unit (an image-transferred-but-unfixed paper sheet), and stores the existence/nonexistence of an image-transferred-but-unfixed paper sheet) among the troubled paper sheets (step S105 in FIG. 6).

In a case where a trouble detection result is sent between times T1 and T2 that are calculated from time T0 at which the exposing unit starts exposure on the image carrier 151, time t1 before which transfer of a toner image is started by the rotation of the image carrier 151, the conveyance distance d1 from the position of the transferring unit to the fixing unit, the paper sheet length pd1, and the conveyance speed v2, the control unit 101 determines that the troubled paper sheets include an image-transferred-but-unfixed paper sheet.

Here, $T1=T0+t1$, and $T2=T0+t1+(d1+pd1)/v2$.

Although the conveyance of the remaining paper sheets in the image forming apparatus 100 is stopped when a trouble is detected, the remaining paper sheets might be moving through inertia until coming to a halt. In a case where a sensor is placed near the exit of the fixing unit, the control unit 101 can determine that the troubled paper sheets include no image-transferred-but-unfixed paper sheets if the bottom edge of a paper sheet is detected by the sensor near the exit of the fixing unit at time T2, and the control unit 101 can determine that the troubled paper sheets include an image-transferred-but-unfixed paper sheet if the sensor near the exit of the fixing unit continues to detect a paper sheet.

Figure 9:
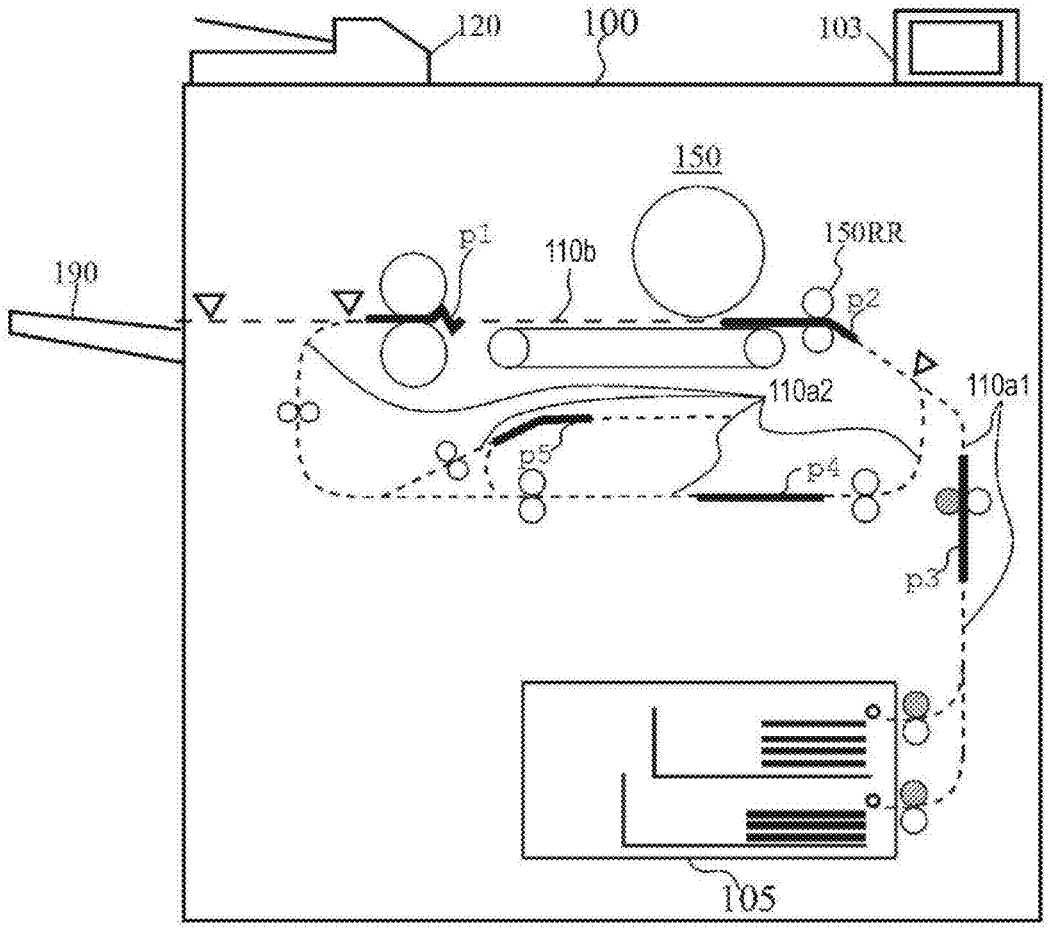
FIG. 9 is a diagram for explaining another situation of paper sheet conveyance in the embodiment of the present invention.

FIG. 9 schematically shows a situation where a trouble occurs in the paper sheet p1 while the image forming apparatus 100 is performing image formation. Here, the paper sheet p1 is the trouble-causing paper sheet. The four paper sheets p2 to p5 exist as the remaining paper sheets.

In this case, the troubled paper sheets do not include any image-transferred-but-unfixed paper sheet.

Figure 10:
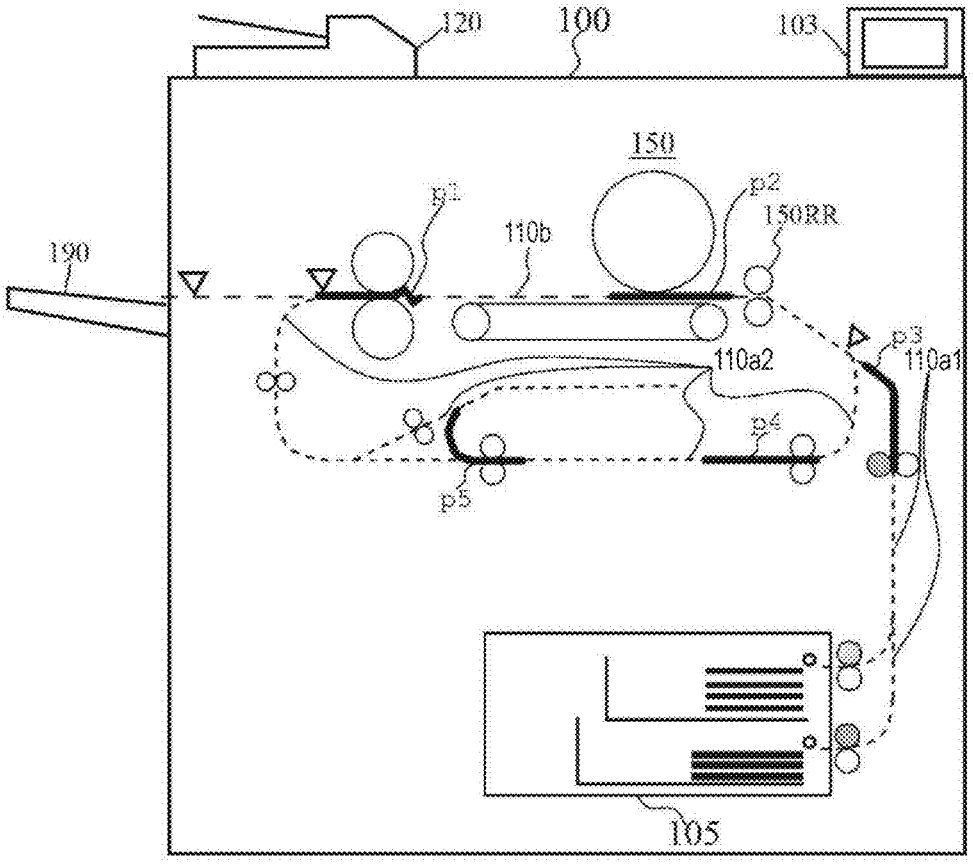
FIG. 10 is a diagram for explaining yet another situation of paper sheet conveyance in the embodiment of the present invention.

FIG. 10 schematically shows a situation where a trouble occurs in the paper sheet p1 while the image forming apparatus 100 is performing image formation. Here, the paper sheet p1 is the trouble-causing paper sheet. The four paper sheets p2 to p5 exist as the remaining paper sheets. In this case, a toner image has been transferred from the image carrier 151 onto the paper sheet p2 as a troubled paper sheet in the image forming unit 150, but the toner image has not been fixed onto the paper sheet p2. Therefore, the paper sheet p2 is an image-transferred-but-unfixed paper sheet.

As the trouble detecting unit 115 or the like has notified the control unit 101 of a trouble detection result that is a notification of a paper jam occurrence, the control unit 101 performs a trouble-causing paper sheet removing process to cause the user to remove the trouble-causing paper sheet (step S106 in FIG. 6). In this trouble-causing paper sheet removing process, the control unit 101 causes the operation display unit 103 to display the position of the trouble-causing paper sheet and the procedures for removing the trouble-causing paper sheet. In this manner, the control unit 101 prompts the user to remove the trouble-causing paper sheet.

The control unit 101 continues the trouble-causing paper sheet removing process, until the trouble detecting unit 115 or the like notifies the control unit 101 of solution of the trouble based on results of detection performed by sensors placed at respective positions in the conveying unit (NO in step S107, and step S106 in FIG. 6).

When the trouble detecting unit 115 or the like notifies the control unit 101 of solution of the trouble (YES in step S107 in FIG. 6), the control unit 101 checks whether the purging process is to be performed in accordance with the setting (made in step S101 in FIG. 6) in regard to the existence/nonexistence of the purging process (step S108 in FIG. 6).

If the purging process is not to be performed (NO in step S108 in FIG. 6), the control unit 101 causes the operation display unit 103 to display the positions of the troubled paper sheets and the procedures for removing the troubled paper sheets, and thus prompts the user to manually remove the troubled paper sheets through a paper jam solving process (step S109 in FIG. 6).

If the purging process is to be performed (YES in step S108 in FIG. 6), on the other hand, the control unit 101 determines whether the conveyance speed during the purging process is to be adjusted to the paper type of the troubled paper sheets (step S110 in FIG. 6), determines whether the conveyance speed during the purging process is to be made compatible with the existence of an image-transferred-but-unfixed paper sheet when being adjusted to the paper type of the troubled paper sheets (step S111 in FIG. 6), and determines whether there is an image-transferred-but-unfixed paper sheet in a case where the conveyance speed during the purging process is to be made compatible with the existence of an image-transferred-but-unfixed paper sheet when being adjusted to the paper type of the troubled paper sheets (step S112 in FIG. 6).

If the purging process is to be performed (YES in step S108 in FIG. 6), and the conveyance speed during the purging process is not to be adjusted to the paper type of the troubled paper sheets (NO in step S110 in FIG. 6), the control unit 101 sets the conveyance speed during the purging process at a predetermined conveyance speed that is the highest speed, the intermediate speed, or the conveyance speed used immediately before the occurrence of the trouble in accordance with the setting ("high-speed purge mode", "intermediate-speed purge mode", or "previous-state-applied purge mode") (step S113 in FIG. 6).

If the purging process is to be performed (YES in step S108 in FIG. 6), the conveyance speed during the purging process is to be adjusted to the paper type of the troubled paper sheets (YES in step S110 in FIG. 6), the existence of an image-transferred-but-unfixed paper sheet is taken into consideration when the conveyance speed during the purging process is adjusted to the paper type of the troubled paper sheets (YES in step S111 in FIG. 6), and there is no image-transferred-but-unfixed paper sheet (NO in step S112 in FIG. 6), the control unit 101 also sets the conveyance speed during the purging process in accordance with the setting ("high-speed purge mode", "intermediate-speed purge mode", or "previous-state-applied purge mode") (step S113 in FIG. 6).

In this case, the control unit 101 performs the setting so that the conveyance speed of the sheet conveying unit 110*a*1, the conveyance speed of the sheet conveying unit 110*a*2, and the conveyance speed of the process conveying unit 110*b* become uniform. In a case where the sheet feeding apparatus 50 is used, the control unit 101 performs the setting so that the conveyance speed in the sheet feeding apparatus 50, the speed of conveyance from the sheet feeding apparatus 50 to the sheet conveying unit 110*a*3 in the image forming apparatus 100, the conveyance speed of the sheet conveying unit 110*a*1, the conveyance speed of the sheet conveying unit 110*a*2, and the conveyance speed of the process conveying unit 110*b* become uniform.

If the purging process is to be performed (YES in step S108 in FIG. 6), the conveyance speed during the purging process is to be adjusted to the paper type of the troubled paper sheets (YES in step S110 in FIG. 6), and the existence of an image-transferred-but-unfixed paper sheet is not taken into consideration when the conveyance speed during the purging process is adjusted to the paper type of the troubled paper sheets (NO in step S111 in FIG. 6), the control unit 101 sets the conveyance speed during the purging process in accordance with the paper type of the troubled paper sheets (step S114 in FIG. 6).

If the purging process is to be performed (YES in step S108 in FIG. 6), the conveyance speed during the purging process is to be adjusted to the paper type of the troubled paper sheets (YES in step S110 in FIG. 6), the existence of an image-transferred-but-unfixed paper sheet is taken into consideration when the conveyance speed during the purging process is adjusted to the paper type of the troubled paper sheets (YES in step S111 in FIG. 6), and there is an image-transferred-but-unfixed paper sheet (YES in step S112 in FIG. 6), the control unit 101 also sets the conveyance speed during the purging process in accordance with the paper type of the troubled paper sheets (step S114 in FIG. 6).

Here, so as to determine the conveyance speed during the purging process in accordance with the paper type of the troubled paper sheets, a conveyance speed is set so that appropriate fixing will be performed even on an image-transferred-but-unfixed paper sheet by the fixing unit, with attention being paid to the fixing properties of the fixing unit that are determined mainly by the thickness of the paper sheets. Accordingly, in a case where the paper sheets are thick, the conveyance speed is an intermediate speed or a low speed.

In this case, the control unit 101 performs the setting so that the conveyance speed of the sheet conveying unit 110*a*1, the conveyance speed of the sheet conveying unit 110*a*2, and the conveyance speed of the process conveying unit 110*b* become uniform. In a case where the sheet feeding apparatus 50 is used, the control unit 101 performs the setting so that the conveyance speed in the sheet feeding apparatus 50, the speed of conveyance from the sheet feeding apparatus 50 to the sheet conveying unit 110*a*3 in the image forming apparatus 100, the conveyance speed of the sheet conveying unit 110*a*1, the conveyance speed of the sheet conveying unit 110*a*2, and the conveyance speed of the process conveying unit 110*b* become uniform.

In the above described manner, the control unit 101 sets the conveyance speed during the purging process based on the setting in regard to the conveyance speed and the existence/nonexistence of an image-transferred-but-unfixed paper sheet (steps S110 to S114 in FIG. 6), and then controls the respective components to perform the purging process at the set conveyance speed (step S115 in step FIG. 6).

Accordingly, conveyance control is performed by the control unit 101 so that the conveyance speed of the sheet conveying unit 110*a*1, the conveyance speed of the sheet conveying unit 110*a*2, and the conveyance speed of the process conveying unit 110*b* become uniform. In a case where the sheet feeding apparatus 50 is used, control is performed so that the conveyance speed in the sheet feeding apparatus 50 and all the conveyance speeds in the image forming apparatus 100, including the speed of conveyance from the sheet feeding apparatus 50 to the sheet conveying unit 110*a*3, become uniform.

As a result, the paper sheet that is being conveyed to the image forming unit 150 by the sheet conveying unit 110*a* and is also being conveyed by the process conveying unit 110*b* in the image forming unit 150 is conveyed at the same conveyance speed in both units. Accordingly, the paper sheet is not folded or crumpled by being pushed from the bottom. Thus, troubled paper sheets can be stably discharged through the purging process.

While the purging process is performed, the control unit 101 monitors results of detection performed by sensors placed in the respective conveying units. If any notification of detection of a paper sheet is not generated from any of the sensors over a predetermined period of time, the control unit 101 determines that the purging process has been completed (YES in step S116 in FIG. 6). As the control unit 101 refers to results of detection performed by the sensors, the troubled paper sheets can be certainly discharged in a more stable manner through the purging process.

While this purging process is performed, the control unit 101 performs control so that the troubled paper sheets are discharged to the outside without a halt through a continuous conveyance process. That is, in the purging process, the control unit 101 performs control so that the conveyance does not stop even at the resist rollers 150RR. In this manner, any extra force is not applied onto the troubled paper sheets, and the troubled paper sheets continue to be conveyed at a constant conveyance speed in the entire route. Accordingly, the troubled paper sheets can be stably discharged through the purging process.

When determining that the purging process has been completed, the control unit 101 stops the operations of the respective components of the image forming apparatus 100 and the like (the image forming apparatus 100 when only the image forming apparatus 100 is operated, and the sheet feeding apparatus 50 and the image forming apparatus 100 and the post-processing apparatus 300 when the image forming system is operated) (step S117 in FIG. 6).

When a paper jam solving process (step S109 in FIG. 6) is manually performed, the control unit 101 also stops the operations of the respective components of the image forming apparatus 100 and the like (the image forming apparatus 100 when only the image forming apparatus 100 is operated, and the sheet feeding apparatus 50 and the image forming apparatus 100 and the post-processing apparatus 300 when the image forming system is operated) (step S117 in FIG. 6).

If there is a job resumption instruction from the user to the operation display unit 103 after that (YES in step S118 in FIG. 6), the control unit 101 performs a recovery process (step S119 in FIG. 6), to resume the image formation, starting from the portions equivalent to the jam-causing paper sheet and the jammed paper sheets discharged through the purging process. The control unit 101 then repeats the image formation until an image is formed on the last paper sheet among the designated number of paper sheets in the job (step S120 in FIG. 6).

Although the image forming apparatus 100 and the image forming system have been described above, the present invention is not limited to them. Specifically, in accordance with an image formation control program, the control unit(s) of the image forming apparatus 100 or the image forming system is made to operate in a predetermined manner so that the above described purging process can be performed.

[Modification (1)]

Various modifications may be made to the aspects described as specific examples in the above embodiment, without degrading the characteristics and the advantageous effects of this embodiment.

For example, the conveyance speed of the sheet conveying unit 110*a*1 at a time of image formation and the circulating sheet conveyance speed of the sheet conveying unit 110*a*2 at a time of two-sided image formation are both v1 in the description with reference to FIG. 5. However, the present invention is not limited to that, and different conveyance speeds may be used. Specifically, as long as the conveyance speeds of the respective components are uniform at the process conveyance speed v2 during the purging process, various modifications may be made to the conveyance speeds at a time of regular image formation. The same applies to the sheet conveying unit 110*a*3 extending from the sheet feeding apparatus 50.

[Modification (2)]

As for the uniform process conveyance speed v2 of the respective components during the purging process, not only the conveyance speeds are strictly uniform, but also the sheet conveyance speed of the sheet conveying unit 110*a* (110*a*1, 110*a*2, and 110*a*3) is controlled not to exceed the process conveyance speed of the process conveying unit 110*b*.

As a result, even a paper sheet that is being conveyed to the image forming unit 150 by the sheet conveying unit 110*a* and is also being conveyed by the process conveying unit 110*b* in the image forming unit 150 is not folded or crumpled by being pushed from the bottom. Accordingly, troubled paper sheets can be stably discharged through the purging process.

[Modification (3)]

When the purging process is performed, not only the conveyance speed (the discharging conveyance speed) of the discharging unit 190 in the image forming apparatus 100, the conveyance speed (the discharging conveyance speed) in the post-processing apparatus 300 in the image forming system, and the conveyance speed (the discharging conveyance speed) of the discharging unit 390 of the post-processing apparatus 300 in the image forming system are made uniform at the process conveyance speed, but also the above discharging conveyance speeds are controlled not to exceed the process conveyance speed of the process conveying unit 110*b*.

As a result, even a paper sheet that is being conveyed by the process conveying unit 110*b* in the image forming unit 150 and is also being conveyed by the discharging unit 190 or the post-processing apparatus 300 located on the downstream side of the process conveying unit 110*b* is not folded or crumpled by being pushed from the bottom. Accordingly, troubled paper sheets can be stably discharged through the purging process.

According to an embodiment of the present invention, with the image forming apparatus, the image forming system, and the image formation control program as a mode to solve the above described problem, the effects described below are to be achieved.

(1) According to an embodiment of the present invention, when the purging process is performed to discharge a remaining paper sheet, the conveyance speed at which the troubled paper sheet are conveyed to the image forming unit and the conveyance speed at which the troubled paper sheet is conveyed in the image forming unit are both controlled to be equal to the second conveyance speed as the conveyance speed for image formation. With this, even a paper sheet that is being conveyed to the image forming unit and is also being conveyed in the image forming unit at the same conveyance speed is not folded or crumpled by being pushed from the bottom. Accordingly, troubled paper sheets can be stably discharged through the purging process.

(2) According to an embodiment of the present invention, in a case where the second conveyance speed can be selected from among several speeds in accordance with the type of the paper sheet in Item. (1), control is performed so as to determine the second conveyance speed in accordance with the type of the troubled paper sheet. Accordingly, even a troubled paper sheet onto which a toner image has been transferred but has not been fixed yet, the troubled paper sheet can be discharged through the purging process while the fixing is performed in a stable manner.

(3) According to an embodiment of the present invention, in Item. (2), the second conveyance speed during the purge process can be selectively determined in accordance with the type of the troubled paper sheet or regardless of the type of the troubled paper sheet. Accordingly, the troubled paper sheet can be discharged through a stable purging process that puts emphasis on fixing properties or conveyance properties.

(4) According to an embodiment of the present invention, in a case where the second conveyance speed can be selected from several speeds in Item. (1), a speed that is closer to the highest speed than to the intermediate speed is selected as the second conveyance speed to be used in the purging process. Accordingly, discharging can be performed through a stable purging process that puts emphasis on productivity.

(5) According to an embodiment of the present invention, when the purging process is performed in Items. (2) to (4), the second conveyance speed can be determined in accordance with the type of the troubled paper sheet, or a speed that is closer to the highest speed than to the intermediate speed among the speeds is determined to be the second conveyance speed, regardless of the type of the troubled paper sheet. Accordingly, discharging can be performed through a stable purging process that puts emphasis on fixing properties, or a stable purging process that puts emphasis on productivity.

(6) According to an embodiment of the present invention, when the purging process is performed in Items. (2), (3), and (5), the second conveyance speed is determined in accordance with the type of the troubled paper sheet if there is an unfixed troubled paper sheet, and the second conveyance speed is determined regardless of the paper type if there is no unfixed troubled paper sheet. Accordingly, discharging can be performed while a balance is kept between a stable purging process that puts emphasis on fixing properties and a stable purging process that puts emphasis on productivity.

(7) According to an embodiment of the present invention, in Item. (1), the second conveyance speed to be used in the purging process is determined based on the second conveyance speed of the paper sheet used before the trouble is detected by the trouble detecting unit. Accordingly, the troubled paper sheet can be stably discharged through the purging process, with the settings reflecting the user's intention.

(8) According to an embodiment of the present invention, as the troubled paper sheet is discharged to the outside without a halt when the purging process is performed in Items. (1) to (7), any extra force is not applied onto the troubled paper sheets, and the troubled paper sheet continues to be conveyed at the second conveyance speed. Accordingly, the troubled paper sheet can be stably discharged through the purging process.

(9) According to an embodiment of the present invention, when the purging process is carried out while the paper sheet is searched for by a sensor provided in the conveying unit in Items. (1) to (8), the purging process is determined to have been completed if a notification of detection of the paper sheet is not generated from the sensor over a predetermined period of time. Accordingly, the troubled paper sheet can be certainly discharged in a stable manner through the purging process.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming apparatus comprising:

an image forming unit configured to form an image on a paper sheet;

a conveying unit configured to convey the paper sheet to the image forming unit at a first conveyance speed and convey the paper sheet in the image forming unit at a second conveyance speed when the image is formed on the paper sheet in the image forming unit, the second conveyance speed being lower than the first conveyance speed;

a trouble detector configured to detect a trouble related to conveyance of the paper sheet in the conveying unit; and a processor configured to control the conveyance of the paper sheet in the conveying unit and the image formation on the paper sheet in the image forming unit, wherein, when the trouble detector detects the trouble from the paper sheet being conveyed, and the processor controls the conveying unit to perform a purging process to discharge a troubled paper sheet to the outside of the apparatus after a trouble-causing paper sheet that has caused the trouble is removed, the processor controls a conveyance speed at which the troubled paper sheet is conveyed to the image forming unit and a conveyance speed at which the troubled paper sheet is conveyed in the image forming unit to be equal to the second conveyance speed, the trouble-causing paper sheet being the paper sheet from which the trouble is detected by the trouble detector, the troubled paper sheet being the paper sheet remaining in the apparatus other than the trouble-causing paper sheet when the trouble is detected by the trouble detector, wherein when the purging process is performed, the processor controls a conveyance speed of a roller, which conveys the paper sheet at the first conveyance speed during a regular image formation, to be the second conveyance speed, and wherein, when controlling the conveying unit to perform the purging process, the processor determines whether there is a troubled paper sheet onto which an image has been transferred in the image forming unit but has not been fixed, determines the second conveyance speed in accordance with a type of the troubled paper sheet when there is the unfixed troubled paper sheet, and determines the second conveyance speed regardless of the paper type when there is no unfixed troubled paper sheet.

2. The image forming apparatus according to claim 1, wherein the processor controls the conveying unit to discharge the troubled paper sheet to the outside without a halt when performing the purging process.

3. The image forming apparatus according to claim 1, further comprising:

a sensor at a site in the conveying unit, the sensor being configured to detect the paper sheet, wherein, when a notification of detection of the paper sheet is not generated from the sensor over a predetermined period of time while the purging process is performed, the processor determines that the purging process has been completed.

4. A non-transitory computer-readable recording medium having an image formation control program stored thereon for controlling a computer of an image forming apparatus, the image forming apparatus including an image forming unit configured to form an image on a paper sheet; a conveying unit configured to convey the paper sheet to the image forming unit at a first conveyance speed and convey the paper sheet in the image forming unit at a second conveyance speed when the image is formed on the paper sheet in the image forming unit, the second conveyance speed being lower than the first conveyance speed; and a trouble detector configured to detect a trouble related to conveyance of the paper sheet in the conveying unit, and the program being executable by the computer to perform functions comprising:

controlling the conveyance of the paper sheet in the conveying unit and the image formation on the paper sheet in the image forming unit;

when the trouble detector detects a trouble from the paper sheet being conveyed, and the conveying unit is controlled to perform a purging process to discharge a troubled paper sheet to the outside of the apparatus after a trouble-causing paper sheet that has caused the trouble is removed, adjusting a conveyance speed at which the troubled paper sheet is conveyed to the image forming unit and a conveyance speed at which the troubled paper sheet is conveyed in the image forming unit to be equal to the second conveyance speed, the trouble-causing paper sheet being the paper sheet from which the trouble is detected by the trouble detector, and the troubled paper sheet being the paper sheet remaining in the apparatus other than the trouble-causing paper sheet when the trouble is detected by the trouble detector, wherein when the purging process is performed, a conveyance speed of a roller, which conveys the paper sheet at the first conveyance speed during a regular image formation, is controlled to be the second conveyance speed; and determining, when the conveying unit is controlled to perform the purging process, whether there is a troubled paper sheet onto which an image has been transferred in the image forming unit but has not been fixed, determining the second conveyance speed in accordance with a type of the troubled paper sheet when there is the unfixed troubled paper sheet, and determining the second conveyance speed regardless of the paper type when there is no unfixed troubled paper sheet.

5. The non-transitory computer-readable recording medium according to claim 4, the program being executable by the computer to perform further functions comprising:

controlling the conveying unit to discharge the troubled paper sheet to the outside without a halt when performing the purging process.

6. The non-transitory computer-readable recording medium according to claim 4, wherein a sensor configured to detect the paper sheet is provided at a site in the conveying unit, and wherein the program is executable by the computer to perform a further function of, when a notification of detection of the paper sheet is not generated from the sensor over a predetermined period of time while the purging process is performed, determining that the purging process has been completed.

7. An image forming apparatus comprising:

an image forming unit configured to form an image on a paper sheet;

a conveying unit configured to convey the paper sheet to the image forming unit at a first conveyance speed and convey the paper sheet in the image forming unit at a second conveyance speed when the image is formed on the paper sheet in the image forming unit, the second conveyance speed being lower than the first conveyance speed;

a trouble detector configured to detect a trouble related to conveyance of the paper sheet in the conveying unit; and a processor configured to control the conveyance of the paper sheet in the conveying unit and the image formation on the paper sheet in the image forming unit, wherein, when the trouble detector detects the trouble from the paper sheet being conveyed, and the processor controls the conveying unit to perform a purging process to discharge a troubled paper sheet to the outside of the apparatus after a trouble-causing paper sheet that has caused the trouble is removed, the processor controls a conveyance speed at which the troubled paper sheet is conveyed to the image forming unit and a conveyance speed at which the troubled paper sheet is conveyed in the image forming unit to be equal to the second conveyance speed, the trouble-causing paper sheet being the paper sheet from which the trouble is detected by the trouble detector, the troubled paper sheet being the paper sheet remaining in the apparatus other than the trouble-causing paper sheet when the trouble is detected by the trouble detector, and wherein the processor determines the second conveyance speed based on whether or not there is a troubled paper sheet onto which an image has been transferred in the image forming unit but has not been fixed.

8. The image forming apparatus according to claim 7, wherein the processor controls the conveying unit to convey the paper sheet at the second conveyance speed in accordance with a type of the paper sheet in the image forming unit, the processor performing control so as to determine the second conveyance speed in accordance with a type of the troubled paper sheet when controlling the conveying unit to perform the purging process.

9. The image forming apparatus according to claim 7, wherein the processor selectively determines the second conveyance speed in accordance with a type of the troubled paper sheet or determines the second conveyance speed regardless of the type of the troubled paper sheet when controlling the conveying unit to perform the purging process.

10. The image forming apparatus according to claim 7, wherein when the processor selects the second conveyance speed from among a plurality of speeds, the processor performs control to select a speed closer to a highest speed than to an intermediate speed from among the plurality of speeds when controlling the conveying unit to perform the purging process.

11. The image forming apparatus according to claim 7, wherein the processor selectively determines the second conveyance speed in accordance with a type of the troubled paper sheet or determines the second conveyance speed to be a speed closer to a highest speed than to an intermediate speed among a plurality of speeds regardless of the type of the troubled paper sheet when controlling the conveying unit to perform the purging process.

12. The image forming apparatus according to claim 7, wherein the processor determines the second conveyance speed during the purging process based on the second conveyance speed of the paper sheet used before the trouble is detected by the trouble detecting unit.

13. An image forming system comprising:

the image forming apparatus according to claim 7; and a sheet feeding apparatus connected to the image forming apparatus so as to convey a stored paper sheet to the image forming apparatus, the sheet feeding apparatus comprising:

a conveying unit of the sheet feeding apparatus configured to convey the paper sheet to the image forming unit in the image forming apparatus at the first conveyance speed when an image is formed on the paper sheet in the image forming unit; and a trouble detector of the sheet feeding apparatus configured to detect a trouble related to the conveyance of the paper sheet in the conveying unit of the sheet feeding apparatus, wherein, when the trouble detector of the sheet feeding apparatus detects the trouble from the paper sheet being conveyed, and the processor in the image forming apparatus controls the conveying unit of the sheet feeding apparatus to perform a purging process to discharge a troubled paper sheet to the outside of the image forming system after a trouble-causing paper sheet that has caused the trouble is removed, the processor in the image forming apparatus controls a conveyance speed at which the troubled paper sheet is conveyed in the image forming apparatus or the sheet feeding apparatus to the image forming unit and a conveyance speed at which the troubled paper sheet is conveyed in the image forming unit to be equal to the second conveyance speed, the trouble-causing paper sheet being the paper sheet from which the trouble is detected in the image forming system, the troubled paper sheet being the paper sheet remaining in the image forming system other than the trouble-causing paper sheet when the trouble is detected, and wherein when the purging process is performed, the processor controls a conveyance speed of a roller of the sheet feeding apparatus, which conveys the paper sheet at the first conveyance speed during the regular image formation, to be the second conveyance speed.

14. A non-transitory computer-readable recording medium having an image formation control program stored thereon for controlling a computer of an image forming apparatus, the image forming apparatus including an image forming unit configured to form an image on a paper sheet; a conveying unit configured to convey the paper sheet to the image forming unit at a first conveyance speed and convey the paper sheet in the image forming unit at a second conveyance speed when the image is formed on the paper sheet in the image forming unit, the second conveyance speed being lower than the first conveyance speed; and a trouble detector configured to detect a trouble related to conveyance of the paper sheet in the conveying unit, and the program being executable by the computer to perform functions comprising:

controlling the conveyance of the paper sheet in the conveying unit and the image formation on the paper sheet in the image forming unit;

when the trouble detector detects a trouble from the paper sheet being conveyed, and the conveying unit is controlled to perform a purging process to discharge a troubled paper sheet to the outside of the apparatus after a trouble-causing paper sheet that has caused the trouble is removed, controlling a conveyance speed at which the troubled paper sheet is conveyed to the image forming unit and a conveyance speed at which the troubled paper sheet is conveyed in the image forming unit to be equal to the second conveyance speed, the trouble-causing paper sheet being the paper sheet from which the trouble is detected by the trouble detector, the troubled paper sheet being the paper sheet remaining in the apparatus other than the trouble-causing paper sheet when the trouble is detected by the trouble detector; and determining the second conveyance speed based on whether or not there is a troubled paper sheet onto which an image has been transferred in the image forming unit but has not been fixed.

15. The non-transitory computer-readable recording medium according to claim 14, the program being executable by the computer to perform further functions comprising:

determining, when the conveying unit is controlled to convey the paper sheet at the second conveyance speed in accordance with a type of the paper sheet in the image forming unit, the second conveyance speed in accordance with a type of the troubled paper sheet when the conveying unit is controlled to perform the purging process.

16. The non-transitory computer-readable recording medium according to claim 14, the program being executable by the computer to perform further functions comprising:

selectively determining the second conveyance speed in accordance with a type of the troubled paper sheet or determining the second conveyance speed regardless of the type of the troubled paper sheet when the conveying unit is controlled to perform the purging process.

17. The non-transitory computer-readable recording medium according to claim 14, the program being executable by the computer to perform further functions comprising:

selecting, when the second conveyance speed can be selected from among a plurality of speeds, a speed closer to a highest speed than to an intermediate speed among the plurality of speeds when the conveying unit is controlled to perform the purging process.

18. The non-transitory computer-readable recording medium according to claim 14, the program being executable by the computer to perform further functions comprising:

selectively determining the second conveyance speed in accordance with a type of the troubled paper sheet or determining the second conveyance speed to be a speed closer to a highest speed than to an intermediate speed among a plurality of speeds regardless of the type of the troubled paper sheet when the conveying unit is controlled to perform the purging process.

19. The non-transitory computer-readable recording medium according to claim 14, the program being executable by the computer to perform further functions comprising:

determining the second conveyance speed during the purging process based on the second conveyance speed of the paper sheet used before the trouble is detected by the trouble detector.

20. A non-transitory computer-readable recording medium having an image formation control program stored thereon for controlling a computer of an image forming system, the image forming system including the image forming apparatus according to claim 14 and a sheet feeding apparatus connected to the image forming apparatus so as to convey a stored paper sheet to the image forming apparatus, the sheet feeding apparatus including a conveying unit of the sheet feeding apparatus configured to convey the paper sheet to the image forming unit in the image forming apparatus at the first conveyance speed when an image is formed on the paper sheet in the image forming unit and a trouble detector of the sheet feeding apparatus configured to detect a trouble related to the conveyance of the paper sheet in the conveying unit of the sheet feeding apparatus, and the program being executable by the computer to perform functions comprising:

when the trouble detector of the sheet feeding apparatus detects the trouble from the paper sheet being conveyed, and the controller in the image forming apparatus controls the conveying unit of the sheet feeding apparatus to perform a purging process to discharge a troubled paper sheet to the outside of the image forming system after a trouble-causing paper sheet that has caused the trouble is removed, controlling a conveyance speed at which the troubled paper sheet is conveyed in the image forming apparatus or the sheet feeding apparatus to the image forming unit and a conveyance speed at which the troubled paper sheet is conveyed in the image forming unit to be equal to the second conveyance speed, the trouble-causing paper sheet being the paper sheet from which the trouble is detected in the image forming system, and the troubled paper sheet being the paper sheet remaining in the image forming system other than the trouble-causing paper sheet when the trouble is detected, wherein when the purging process is performed, a conveyance speed of a roller of the sheet feeding apparatus, which conveys the paper sheet at the first conveyance speed during the regular image formation, is controlled to be the second conveyance speed.

* * * * *